US010132487B2

(12) United States Patent
Lockart et al.

(10) Patent No.: US 10,132,487 B2
(45) Date of Patent: Nov. 20, 2018

(54) LUMINAIRE HEAT SINK

(71) Applicant: PHILIPS LIGHTING HOLDING B.V., Eindhoven (NL)

(72) Inventors: Chad Lockart, Reading, MA (US); Zachary Robert Wessner, Salem, NH (US); Jonathan Stuart Levy, Somerville, MA (US)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 15 days.

(21) Appl. No.: 15/316,495

(22) PCT Filed: May 22, 2015

(86) PCT No.: PCT/IB2015/053797

§ 371 (c)(1),
(2) Date: Dec. 5, 2016

(87) PCT Pub. No.: WO2015/186016

PCT Pub. Date: Dec. 10, 2015

(65) Prior Publication Data

US 2017/0198899 A1 Jul. 13, 2017

Related U.S. Application Data

(60) Provisional application No. 62/007,073, filed on Jun. 3, 2014.

(51) Int. Cl.

| | |
|---|---|
| ***F21V 29/74*** | (2015.01) |
| ***F21V 29/508*** | (2015.01) |
| *F21Y 115/10* | (2016.01) |

(52) U.S. Cl.
CPC ..... *F21V 29/745* (2015.01); *F21V 29/508* (2015.01); *F21Y 2115/10* (2016.08)

(58) Field of Classification Search
CPC ..... F21V 29/745; F21V 29/508; F21V 29/00; F21V 29/004; F21V 29/20; F21V 29/2212; F21V 29/503; F21V 29/70; F21V 29/74; F21V 29/76; F21V 29/75; F21Y 2115/10
See application file for complete search history.

(56) References Cited

U.S. PATENT DOCUMENTS

| | | | | |
|---|---|---|---|---|
| 6,016,038 | A | 1/2000 | Mueller et al. | |
| 6,211,626 | B1 | 4/2001 | Lys et al. | |
| 2009/0052175 | A1* | 2/2009 | Xu | F21K 9/00 362/249.01 |
| 2009/0244900 | A1 | 10/2009 | Chang et al. | |
| 2009/0296412 | A1 | 12/2009 | Ogawa et al. | |

(Continued)

OTHER PUBLICATIONS

Marine Location Lighting, LE300 Series, LDPI, Inc., 2014 (2 Pages).

*Primary Examiner* — Bao Q Truong
(74) *Attorney, Agent, or Firm* — Akarsh P. Belagodu

(57) ABSTRACT

The present application is directed to heat sinks for light emitting devices. In particular, the heat sinks can provide effective heat dissipation in a variety of different orientations and positions. In one exemplary heat sink, different groups (110, 120, 130, 140) of essentially parallel fins (112, 122, 132, 142) can be separated and disposed at particular angles to form fluid channels (114, 124, 134, 144, 108 and 109) that enable fluid flow in different directions and orientations.

16 Claims, 3 Drawing Sheets

(56) References Cited

U.S. PATENT DOCUMENTS

| | | | | |
|---|---|---|---|---|
| 2010/0038657 | A1 | 2/2010 | Higuchi et al. | |
| 2011/0037367 | A1 | 2/2011 | Wang et al. | |
| 2011/0075432 | A1 | 3/2011 | Chou et al. | |
| 2012/0057351 | A1* | 3/2012 | Wilcox | F21V 19/0055 362/307 |
| 2013/0265766 | A1 | 10/2013 | Choksi et al. | |
| 2013/0294083 | A1* | 11/2013 | Zheng | F21V 23/008 362/294 |

* cited by examiner

LUMINAIRE HEAT SINK

CROSS-REFERENCE TO PRIOR APPLICATIONS

This application is the U.S. National Phase application under 35 U.S.C. § 371 of International Application No. PCT/IB2015/053797, filed on May 22, 2015, which claims the benefit of U.S. Provisional Patent Application No. 62/007,073, filed on Jun. 3, 2014. These applications are hereby incorporated by reference herein.

TECHNICAL FIELD

The present invention is directed generally to light-emitting systems. More particularly, various inventive apparatus and methods disclosed herein relate to heat sinks for light-emitting devices.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference.

Generally, LED lighting fixtures operate to convert electrical energy to light energy. While the beam of light is cool, the fixture itself creates heat as a by-product from the energy conversion. Excessive amounts heat, when created and maintained for sustained periods of time, can damage temperature-sensitive components of the LED system. To address this issue, heat sinks are used as part of the fixture housing to draw heat away from these sensitive components.

In typical heat sink designs, a thermally conductive material, such as, for example, aluminum, is cast or formed into a shape that is designed to transfer heat away from the electronics to the exterior of the fixture by means of, for example, conduction, convection, and radiation. To maximize heat transfer, heat sink designs aim to have the maximum amount of surface area possible while permitting for sufficient air flow. Areas on the heat sink that enable air flow can aid in natural convection and can provide areas for forced air to travel. For example, wind, which can create forced convection, can travel through these areas of the heat sink. These designs aim to maintain the temperature of the electronics to a sufficient level that can extend the lifetime of the fixture.

SUMMARY

The present disclosure is directed to inventive heat sink methods and apparatus for light-emitting devices. For example, a problem with typical heat sink designs is that they can only operate effectively in certain orientations.

Installing a lighting fixture in other orientations can result in blocked fluid flow, which would normally aid in thermal dissipation. As an example, vertically laying a heat sink that is designed to operate with horizontal fins can create blockages for air travel and can negatively impact the heat sink performance. Another problem is that heat sink fins of these designs can create channels that trap water and debris, specifically when they are employed in outdoor applications. Such channels can lower heat sink performance by decreasing the surface area of the heat sink that is in contact with the surrounding air, or other suitable fluid used to dissipate heat.

In contrast to these heat sink designs, exemplary aspects of the present application can reduce the impact of fixture orientation on thermal performance and/or can reduce water/debris pooling within channels. Thus, exemplary embodiments described herein can mitigate the problems associated with heat sink designs described above to improve heat sink effectiveness and thereby increase a luminaire's lifetime and reliability. For example, in accordance with one feature, fins of the heat sink can be angled and designed to permit relatively unobstructed fluid flow in a plurality of different orientations. Here, groups of fins may be separated to enable fluid to flow through the fins in the separated areas as well as through channels formed within the groups of fins. These separated areas can enable fluid to flow in directions that are different from the directions in which fluid flows through the channels formed in the individual groups of fins. As such, these features can reduce the risk of fixture failure due to thermal overloading when the heat sink is installed in a variety of different orientations, thereby providing a user with more freedom to select a desired orientation for the light fixture. In addition, the heat sink can include sloped and/or curved surfaces that permit drainage of water and roll-off of debris, such as, for example, dust and dirt. These features can avoid pooling of water, which can negatively affect thermal performance and can corrode metal and cosmetic coatings.

Generally, in one aspect, a heat sink for a light-emitting device includes a first group of fins forming first fluid channels on a surface of the heat sink and a second group of fins forming second fluid channels on the heat sink surface. Here, the second group of fins are adjacent to the first group of fins. The fins of the first group are essentially parallel and the fins of the second group are also essentially parallel. Further, an average angle between the fins of the first group and the fins of the second group is greater than or equal to 15° and less than or equal to 165°. As indicated above, this configuration of fins can permit relatively unobstructed fluid flow in a plurality of different orientations. Further, as compared to straight coupling of channels between groups of fins, the angling of the fins can increase the total surface area of the heat sink over which a given stream of fluid flows through the channels formed by the groups, which can, in turn, improve the heat dissipation properties of the heat sink.

In accordance with one embodiment, end points of the fins of the first group that are nearest to the second group of fins are separated from end points of the second group that are nearest to the first group. The separation between the fins enables fluid to travel along the heat sink in a direction that is transverse or otherwise different from the directions of the fluid channels formed by the parallel fins. In particular, the separation can ensure that fluid flow is not obstructed by the fins in this direction. Thus, a user can install and adjust the heat sink fixture in a plurality of different orientations that enable the heat sink to provide sufficient heat dissipation for the light-emitting device. In one version of the embodiment, the end points of fins of the first group are disposed above the end points of the fins of the second group. Here, the groups of fins can form a direct, unobstructed channel across at least a portion of the surface of the heat sink to permit a relatively large amount of fluid to flow across the heat sink, which can improve the heat dissipative function of the heat sink. Optionally, each of the end points of the fins of the first group is disposed directly above a corresponding end point of the end points of the fins of the second group. This feature enables fluid to flow seamlessly from channels of one group of the fins to channels of the other group of the fins, while at the same time providing the direct channel discussed above. Alternatively, in another version of the embodiment, the end points of the fins of the first group are disposed below the end points of the fins of the second group. This feature can enable fluid to flow in a winding or zig-zag path around the fins in a general direction that is transverse or otherwise different from the directions of the fluid channels formed by the parallel fins. The winding or zig-zag path permits the fluid to flow over a larger surface area of the heat sink and, in turn, can improve the heat dissipation provided by the heat sink. Optionally, each of the end points of the fins of the first group can be disposed centrally in a corresponding channel of the second fluid channels formed in the second group. Additionally or alternatively, each of the end points of the fins of the second group can be disposed centrally in a corresponding channel of the first fluid channels formed in the first group. These features enable the fluid to flow steadily and consistently around the fins to provide a more uniform heat dissipation across at least a portion of the surface of the heat sink.

In one embodiment, the heat sink includes a third group of fins forming third fluid channels on the surface of the heat sink, where the fins of the third group are essentially parallel and mirror the fins of the first group. The heat sink can further include a fourth group of fins forming fourth fluid channels on the surface of the heat sink, where the fins of the fourth group are essentially parallel and mirror the fins of the second group. Using these features, the groups can be oriented in an X-like configuration, which permits air to flow along the surface of and out of the heat sink in a variety of directions, which can provide more operable, heat dissipative orientations in which the heat sink fixture can be installed.

According to one exemplary embodiment, the surface of the heat sink is sloped and/or curved at least at outer edges of the fluid channels of the first and second groups. As noted above, employing sloped and curved features in this way can significantly improve drainage of water and roll-off of debris, including dust and dirt, to improve the heat dissipation qualities of the heat sink. In one version of the embodiment, the surface of the heat sink is dome-shaped to permit effective drainage and roll-off in a variety of directions out of the heat sink and in a plurality of different orientations of the heat sink.

In a preferred embodiment, the heat sink is incorporated in a lighting system comprising a light-emitting device, where the heat sink is disposed on a backside of the light-emitting device. In one version of this embodiment, the first group of fins is disposed over the light-emitting device and the second group of fins is disposed over power supply components for the light-emitting device. This feature permits a separation or a break between the fins to be situated between the light-emitting device and the power supply components, which can ensure that fluid flows uniformly across the light-emitting device and across the power supply components. Situating the break or separation in this way can avoid buildup of heat in particular areas of the light-emitting device and the power supply components. Avoiding this type of heat buildup is desirable, as the buildup can disrupt the color uniformity of the light output from the device. Optionally, the heat sink can include third and fourth groups of fins that mirror the first and second groups. As discussed above, this feature enables more operable orientations of the heat sink fixture. Further, the third and fourth groups can be disposed over the light-emitting device and the power supply components, respectively, to attain the same benefits discussed above with regard to the positioning of the first and second groups of fins.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

As noted above, a problem with typical heat sink designs for lighting devices is that they operate effectively only in particular orientations. For example, when oriented in certain positions, these heat sink fixtures can trap fluid and prevent it from dissipating heat effectively. In addition, water and debris, including dust and dirt, can also create blockages of heat dissipating fluids when the fixture is in these orientations.

More generally, Applicants have recognized and appreciated that it would be beneficial to angle fins in a way that forms fluid channels that can effectively dissipate heat in a variety of orientations of the heat sink fixture. In particular, exemplary configurations can provide a relatively unobstructed fluid flow in a plurality of directions. Further, groups of fins can be separated to enable fluid to flow through the fins in the separated areas in directions that are different from directions of channels formed within the groups of fins. Further, the heat sink can include sloped and/or curved surfaces to drain water and implement roll-off of debris.

Figure 1:
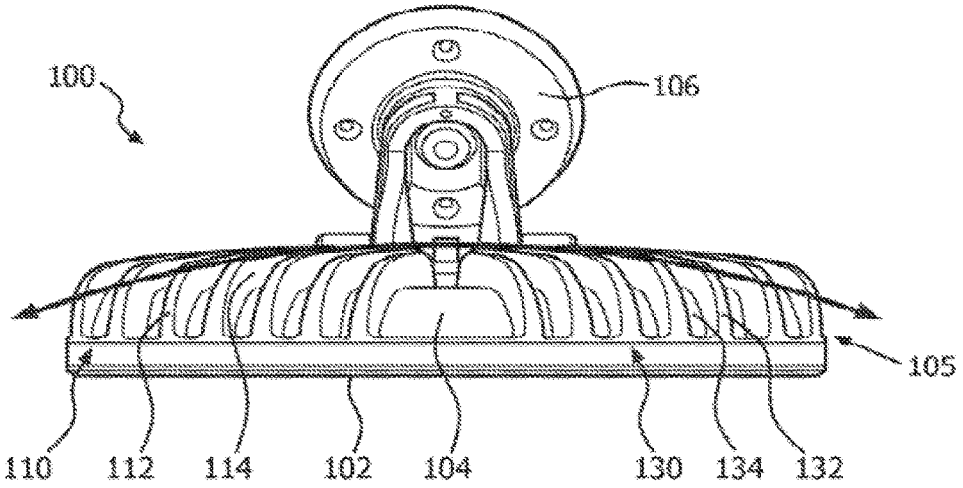
FIG. 1 illustrates a side-view of a lighting system including a heat sink according to an exemplary embodiment.
Figure 2:
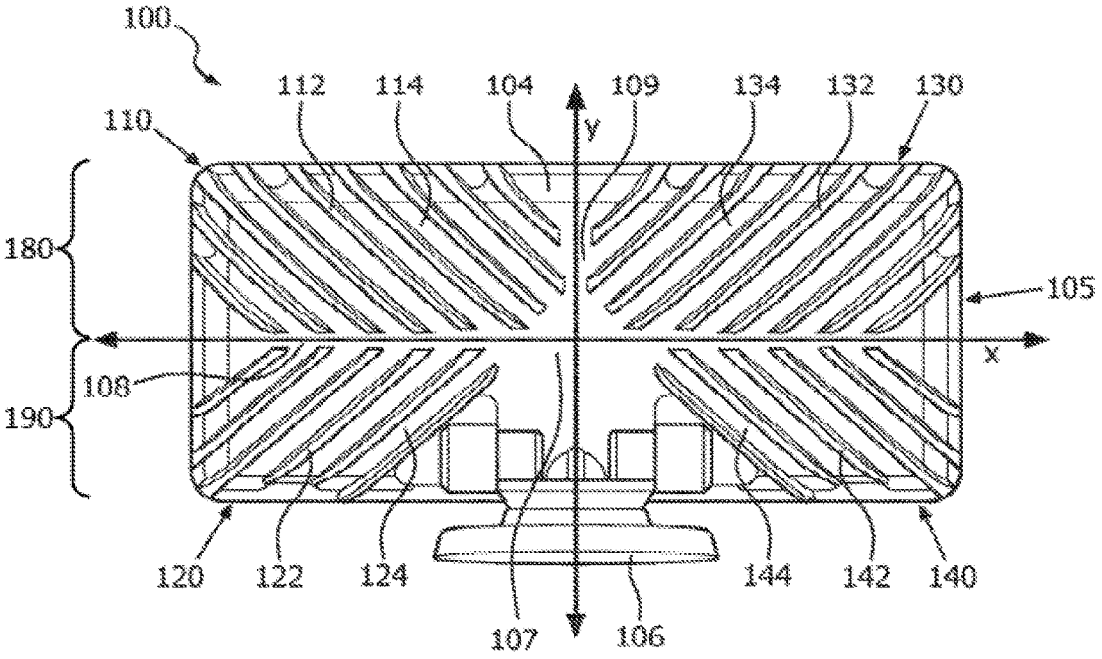
FIG. 2 illustrates a backside view of a lighting system including a heat sink according to an exemplary embodiment.
Figure 3:
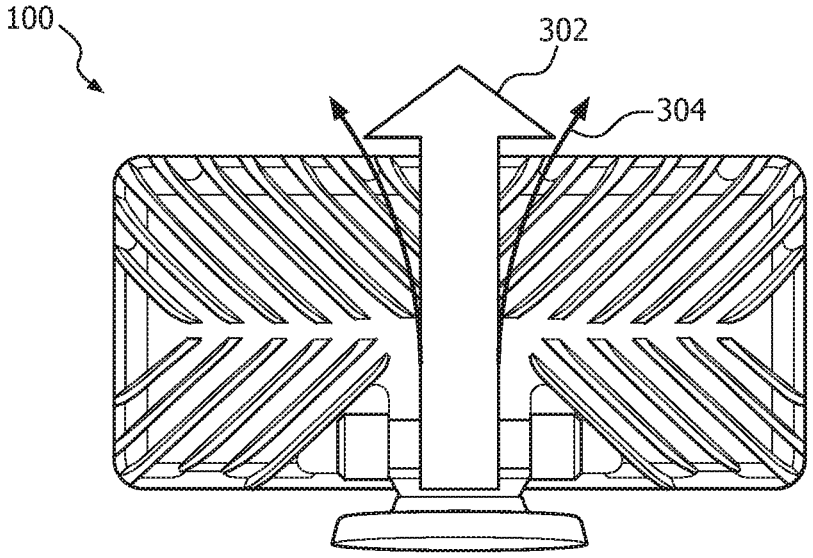
FIG. 3 illustrates a heat dissipative fluid flow across a heat sink of a lighting system according to an exemplary embodiment when the lighting system is oriented horizontally.
Figure 4:
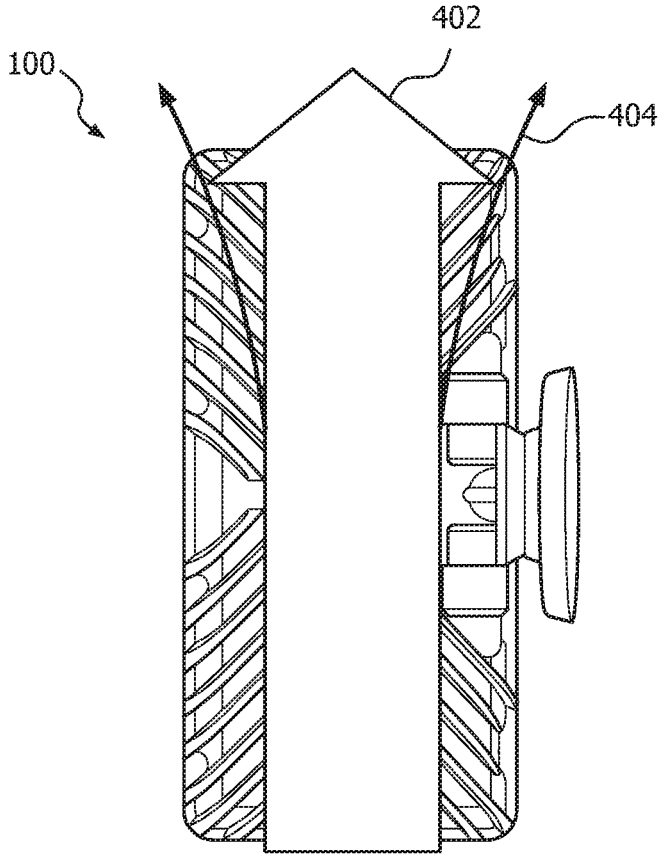
FIG. 4 illustrates a heat dissipative fluid flow across a heat sink of a lighting system according to an exemplary embodiment when the lighting system is oriented vertically.

Referring to FIGS. 1-2, one exemplary embodiment 100 of a lighting system includes groups of fins that form fluid channels on the surface of a heat sink 105 through which fluid, for example air, water, and/or other suitable fluid, can flow to effect heat dissipation for a light-emitting device 102. The fins can be formed in a specific pattern along the back of the system fixture. In other words, the heat sink 105 can be disposed on a backside of the light-emitting device 102, opposite to the light-emitting surface of the device 102. The fin features can be cast or molded into the luminaire housing. The light-emitting device 102 can be an LED or any other suitable light source. The particular embodiment illustrated in FIGS. 1-2 includes a mount 106 and four groups of fins 110, 120, 130 and 140. However, any other suitable number of groups of fins can be employed, including two groups, three groups, four groups, eight groups, etc. As illustrated in FIGS. 1-2, the group 110 includes fins 112 that form fluid channels 114, the group 120 includes fins 122 that form fluid channels 124, the group 130 includes fins 132 that form fluid channels 134 and the group 140 includes fins 142 that form fluid channels 144. In this particular example, group 120 is adjacent group 110, while group 140 is adjacent group 130. In addition, group 130 is disposed laterally from group 110 and mirrors group 110, while group 140 is disposed laterally from group 120 and mirrors group 120. As illustrated in FIG. 2, the channel 108 along the x-axis and the channel 109 along y-axis allow for air or other fluid to escape unobstructed. For example, as illustrated in FIG. 3, when the system 100 is arranged horizontally, the heat can dissipate along directions 302 and 304. In turn, as illustrated in FIG. 4, when the system 100 is arranged vertically, the heat can dissipate along directions 402 and 404. The channels 108 and 109 also allow for water drainage from rain and snow, and roll-off of outdoor debris, such as dust and dirt, through the channels 108 and 109. The rear surface 107 is domed in this particular embodiment and aids in drainage from fixture back as well as in thermal dissipation. As illustrated in FIG. 1, the surface 104 of the heat sink 105 at least near its outer edges, preferably along the whole surface 107, is curved or sloped to permit the drainage of water and roll-off of debris.

The fins are located on the face opposite the direction of light output. The fin pattern should have at least two groups of fins. As illustrated in FIGS. 1-2, within each group 110, 120, 130 and 140 the fins are generally parallel to each other with an overall average angle established for each group. Here, the fins of any particular group, such as fins 112 of group 110, are essentially parallel in that their angle can vary from the average angle of its corresponding group, such as group 110, by about 15° or less. Preferably, the angles of the fins of a given group vary by about 5° or less from the corresponding average angle of the group and most preferably the angles of the fins of a given group vary by about 1° or less from the corresponding average angle of the group. However, in any case, the fins within a given group could be configured so that any given fin should not impede airflow between any of the other fins. In one example, the average angle of the first group is preferably about 15-165 degrees apart from the average angle of the second group. For example, the average angle between the fins of group 110 and the fins of group 120 is ≥15° and ≤165°. Similarly, in this example, the average angle between the fins of group 130 and the fins of group 140 is ≥15° and ≤165°. As illustrated in FIG. 2, this angle relationship forms a "V" shape with the two groups of fins 110 and 120 and similarly with the two groups of fins 130 and 140. With the point of the V pointing in a direction perpendicular to the direction of fluid flow (i.e., fluid flows in a general direction along the y-axis in FIG. 2), fluid can flow up one group of fins, e.g., group 120, and out of the other group of fins, e.g., group 110, without having to make a relatively sharp turn. Preferably, the angle between the two groups of fins, for example, the angle between groups 110 and 120 and/or the angle between groups 130 and 140, is about 90°. This balances performance between x and y directions. However, the angle can be adjusted to bias the performance in a particular axis. For example, if it were desirable to have a slightly better performance in the y-axis direction in FIG. 2, the angle between groups 110 and 120 and/or the angle between groups 130 and 140 can be obtuse to reduce vertical resistance. Similarly, if it were desirable to have a slightly better performance in the x-axis direction, the angle between groups 110 and 120 and/or the angle between groups 130 and 140 can be acute. It should be noted that, according to exemplary aspects, the median angle between any two groups of fins need not align with the x- or y-axis shown FIG. 2. Rather, the median angle between any two groups of fins can be aligned with any arbitrary axis.

To enable the fin pattern to effectively dissipate heat in an orientation where the direction to which the V points is in line with the direction of fluid flow (i.e., fluid flows in the general direction along the x-axis in FIG. 2), the point of the "V" could be broken and the groups of fins could be separated. This will prevent the fluid from being trapped in the V shape. This can be achieved by in a variety of different embodiments.

Figure 5:
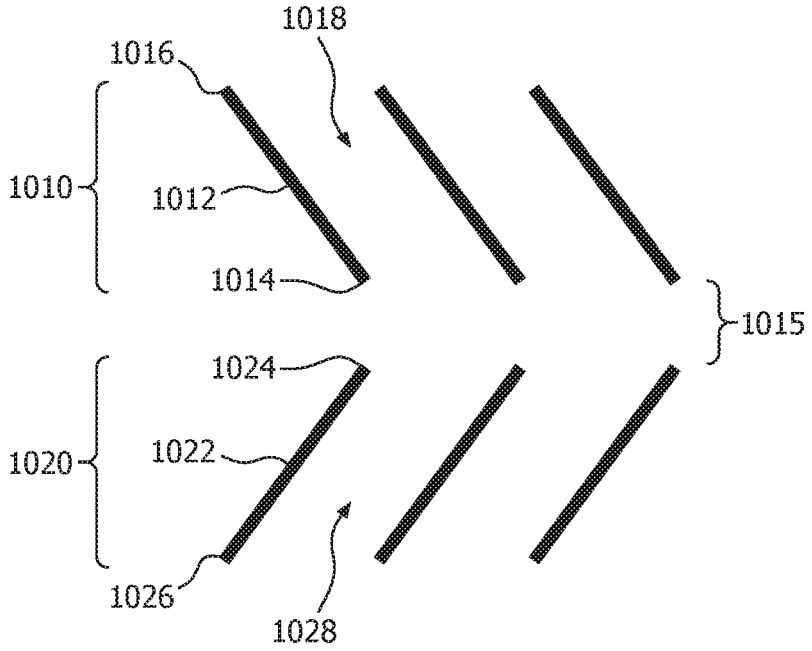
FIG. 5 illustrates a fin configuration that forms a separation channel between groups of fins according to an exemplary embodiment.

For example, as illustrated in FIG. 5, a first group 1010 of fins 1012 is disposed adjacent to a second group 1020 of fins 1022. The end points 1014 of the first group 1010 of fins 1012, which can be group 110, that are nearest to the second group 1020 of fins 1022, which can be group 120, are separated from end points of 1024 of the second group that are nearest to the first group. End points 1014 are nearest to group 1020 in the sense that they are nearer to the group 1020 than endpoints 1016 of the fins 1012. Similarly, end points 1024 are nearer to the group 1020 than endpoints 1026 of the fins 1022. As illustrated in FIG. 5, a cutaway channel 1015, of which channel 108 is an implementation, is created to break the tip of the "V" and allow fluid to flow in and out of this area. Here, the end points 1014 of the fins of the group 1010 are disposed above the end points 1024 of the fins of the group 1020. In particular, the end points 1014 of fins of the group 1010 are disposed directly above a corresponding end point 1024 of the fins of the group 1020. In this way, the groups of fins can form a direct, unobstructed channel 1015 across at least a portion of the surface of the heat sink to permit a relatively large amount of fluid to flow across the heat sink, which can improve the heat dissipative function of the heat sink, as noted above. Further, disposing the endpoints of the first group directly above the corresponding end points of the fins of the second group enables fluid to flow seamlessly from channels 1018 of one group of the fins to channels 1028 of the other group of the fins, while at the same time providing the channel 1015.

Figure 6:
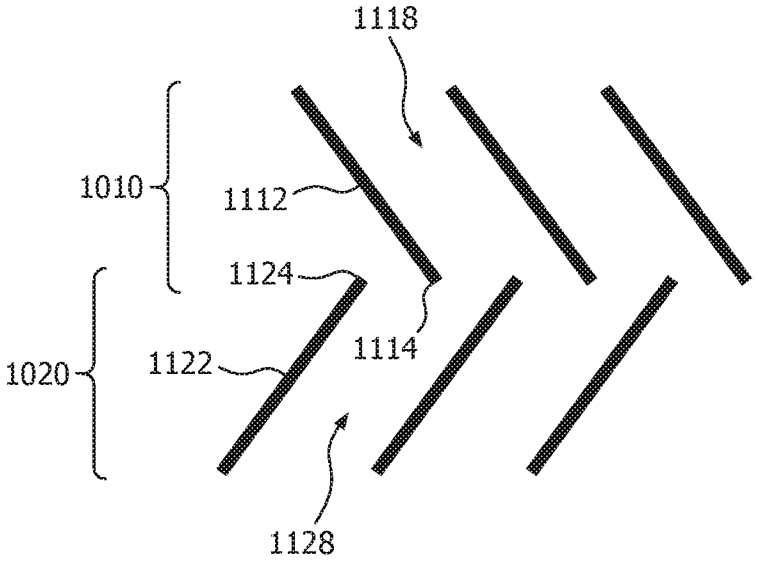
FIG. 6 illustrates a fin configuration that forms a winding channel between groups of fins according to an exemplary embodiment.

Alternatively, the fins of the two groups can be alternating and can partially overlap each other. This configuration permits the fluid to take a winding or zig-zag path through the length of the fixture along this direction. For example, as illustrated in FIG. 6, a first group 1110 of fins 1112 is disposed adjacent to a second group 1120 of fins 1122. The end points 1114 of the first group 1110 of fins 1112, which can be group 110, that are nearest to the second group 1120 of fins 1122, which can be group 120, are separated from end points 1124 of the second group that are nearest to the first group. Specifically, the end points 1114 of fins of the first group 1110 are disposed below the end points 1124 of the fins of the second group 1120. This feature can enable fluid to flow around the fins 1112, 1124 in a winding or zig-zag path around the fins in a general direction that is transverse or otherwise different from the directions of the fluid channels 1118, 1128 formed by the parallel fins. As discussed above, this winding or zig-zag path permits the fluid to flow over a larger surface area of the heat sink and can improve the heat dissipation qualities of the heat sink. In the particular example illustrated in FIG. 6, each of the end points 1114 of the fins of the first group are disposed centrally in a corresponding channel 1128 of the fins of the second group 1120. Similarly, each of the end points 1124 of fins of the second group 1020 is disposed centrally in a corresponding channel 1118 of the first group of fins. Configuring the fins in this way enables the fluid to flow steadily and consistently around the fins in a generally horizontal direction to provide a more uniform heat dissipation.

It should be noted that the proportions of the groups of fins can be varied. For example, as illustrated in FIG. 2, the fins 112 and 132 of groups 110 and 130 are longer than the fins 122 and 142 of groups 120 and 140. Here, the groups 110 and 130 can be disposed over the light-emitting device 180, such as, for example, an LED, of the fixture system. In turn, the groups 110 and 130 can be disposed over the power supply components 190 for the light-emitting device of the fixture. In this example, the air channel break 108 dividing these groups is located essentially between the light-emitting device portion 180 and the power supply portion 190 of the fixture.

As depicted in FIG. 2, groups 110 and 120 are mirrored by groups 130 and 140 across the fixture to create a general "X" shape with four groups of fins. Here, the configurations illustrated in FIG. 5 for groups 110 and 120 are mirrored in groups 130 and 140 to break any other V shapes formed by groups 130 and 140. Alternatively, as noted above, the configuration illustrated in FIG. 6 can be employed. It should be noted that, when the pattern is X shaped, there can be two acute and two obtuse angles formed between the groups, or all four groups could be at right angles with respect to each other. Alternatively, there could be three obtuse angles and one acute angle between the groups or there could be three acute angles and one obtuse angle between the groups.

As indicated above, the surface created at the base of the fins, in between the fins, is sloped, curved or domed to prevent water and debris from collecting in the fluid channels of the heat sink. In particular, at least the outer edges 104 of the surface of the heat sink 105 can be curved or sloped. In the dome implementation, the highest point of the back surface 107 can be located at the central location where all the "V" shapes point, i.e. at the intersection between the x- and y-axes in FIG. 2. The back surface 107 can be sloped, curved or domed away from this point towards the perimeter of the light fixture.

The lighting system 100 can be made from the following non-limiting examples of materials: die-cast aluminum (A360, A380), sand-cast aluminum, machined aluminum (6061-T6), thermally conductive plastics and/or die-cast magnesium. The dimensions of a preferred embodiment of the system 100 are approximately 340 mm×165 mm. In addition, in this exemplary embodiment, the fins can be approximately 2-3 mm thick at the thinnest section and can be about 4-6 mm thick at the bases. The fluid channels can be approximately 12 mm wide. These dimensions are scalable across any heat sink size.

It should be noted that the fin material can be any type of thermally conductive material. In addition, the specific dimensions described above are only a non-limiting example described for illustrative purposes. Alternative designs can include different angles for the fin pattern, alternative thicknesses in fin size, different perimeter ratios, as well as heights of the fins. Furthermore, the fins could be cast, machined, or molded into the heat sink or attached as a secondary component. Moreover, as discussed above, a benefit of the exemplary embodiments described herein is that they can be employed in a plurality of different operable orientations in a variety of different applications. They can be used for any type of thermal dissipation solution, including, for example outdoor LED luminaire fixtures, such as floods, washes, direct viewing, and grazing fixtures and indoor LED luminaire fixtures, such as floods, washes, direct viewing, grazing, and cove fixtures.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A heat sink for a light-emitting device comprising:

a first group of fins forming first fluid channels on a surface of the heat sink, wherein said fins of said first group are essentially parallel; and a second group of fins disposed adjacent to said first group of fins and forming second fluid channels on the surface of the heat sink, wherein said fins of said second group are essentially parallel and wherein an average angle between said fins of said first group and said fins of said second group is greater than 15° and less than 165°;

wherein one or more end points of one or more said fins of said first group are disposed between two or more end points of two or more said fins of said second group within a corresponding channel of said second fluid channels that is defined by the two or more said fins of said second group.

2. The heat sink of claim 1, wherein the end points of said fins of said first group are disposed below the end points of said fins of said second group.

3. The heat sink of claim 2, wherein each of the end points of said fins of said second group are disposed centrally in a corresponding channel of said first fluid channels.

4. The heat sink of claim 1, further comprising:

a third group of fins forming third fluid channels on the surface of the heat sink, wherein said fins of said third group are essentially parallel and mirror said fins of said first group; and a fourth group of fins forming fourth fluid channels on the surface of the heat sink, wherein said fins of said fourth group are essentially parallel and mirror said fins of said second group.

5. The heat sink of claim 1, wherein the surface of the heat sink is at least one of sloped or curved at outer edges of said first and second fluid channels.

6. The heat sink of claim 5, wherein the surface of the heat sink is dome-shaped.

7. Alighting system comprising a light-emitting device and the heat sink of claim 1 disposed on a backside of said light-emitting device.

8. The lighting system of claim 7, wherein the first group of fins is disposed over the light-emitting device.

9. The lighting system of claim 8, wherein the second group of fins is disposed over power supply components for the light-emitting device.

10. The lighting system of claim 9, wherein the heat sink further comprises:

a third group of fins forming third fluid channels on the surface of the heat sink, wherein said fins of said third group are essentially parallel and mirror said fins of said first group and wherein said third group of fins are disposed over the light-emitting device; and a fourth group of fins forming fourth fluid channels on the surface of the heat sink, wherein said fins of said fourth group are essentially parallel and mirror said fins of said second group and wherein said fourth group of fins are disposed over the power supply components for the light-emitting device.

11. A heat sink for a light-emitting device comprising:

a first group of fins extending from a surface of the heat sink and forming first fluid channels on the surface of the heat sink, the first group of fins being essentially parallel to each other;

a second group of fins extending from the surface and disposed adjacent to the first group of fins and forming second fluid channels on the surface of the heat sink, the second group of fins being essentially parallel to each other;

wherein an average angle between the first group of fins and the second group of fins is greater than 15° and less than 165°; and wherein the surface of the heat sink is curved at outer edges of said first and second fluid channels and flat at opposite, interior edges of said first and second fluid channels.

12. The heat sink of claim 11, wherein the first group of fins is disposed over the light-emitting device.

13. The heat sink of claim 11, wherein the second group of fins is disposed over a power supply component for the light-emitting device.

14. The heat sink of claim 13, further comprising:

a third group of fins forming third fluid channels on the surface of the heat sink, the third group of fins being essentially parallel to each other and mirroring the first group of fins, wherein the third group of fins is disposed over the light-emitting device; and a fourth group of fins forming fourth fluid channels on the surface of the heat sink, the fourth group of fins being essentially parallel to each other and mirroring the second group of fins, wherein the fourth group of fins is disposed over the power supply component for the light-emitting device.

15. A lighting system comprising a light-emitting device and the heat sink as recited in claim 11 disposed on a backside of the light-emitting device.

16. A heat sink for a light-emitting device comprising:

a first group of fins forming first fluid channels on a surface of the heat sink, wherein said fins of said first group are essentially parallel; and a second group of fins disposed adjacent to said first group of fins and forming second fluid channels on the surface of the heat sink, wherein said fins of said second group are essentially parallel and wherein an average angle between said fins of said first group and said fins of said second group is greater than 15° and less than 165°;

wherein one or more said fins of said first group are at least partially disposed between two or more said fins of said second group within a corresponding channel of said second fluid channels that is defined by the two or more said fins of said second group.

* * * * *